US009536474B2

(12) United States Patent
Ren et al.

(10) Patent No.: US 9,536,474 B2
(45) Date of Patent: Jan. 3, 2017

(54) PIXEL CIRCUIT HAVING A PLURALITY OF BLUE ORGANIC LIGHT-EMITTING DIODES AND DRIVING METHOD THEREOF

(71) Applicant: BOE TECHNOLOGY GROUP CO., LTD., Beijing (CN)

(72) Inventors: Lijun Ren, Beijing (CN); Liye Duan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 98 days.

(21) Appl. No.: 14/408,485

(22) PCT Filed: May 30, 2014

(86) PCT No.: PCT/CN2014/078971
§ 371 (c)(1),
(2) Date: Dec. 16, 2014

(87) PCT Pub. No.: WO2015/032224
PCT Pub. Date: Mar. 12, 2015

(65) Prior Publication Data

US 2015/0332628 A1 Nov. 19, 2015

(30) Foreign Application Priority Data

Sep. 3, 2013 (CN) ..... 2013 1 0395574

(51) Int. Cl.
*G09G 3/32* (2016.01)
*G09G 3/20* (2006.01)

(52) U.S. Cl.
CPC ..... *G09G 3/3258* (2013.01); *G09G 3/2003* (2013.01); *G09G 3/3233* (2013.01);
(Continued)

(58) Field of Classification Search
CPC ..... G09G 3/3208; G09G 3/3233
(Continued)

(56) References Cited

U.S. PATENT DOCUMENTS 6,225,750 B1 * 5/2001 Kimura ..... G09G 3/2074 315/169.3
2007/0108443 A1 * 5/2007 Kim ..... H01L 27/3202 257/40

(Continued)

FOREIGN PATENT DOCUMENTS

CN 101393924 A 3/2009
CN 101984487 A 3/2011

(Continued)

OTHER PUBLICATIONS

Third Office Action regarding Chinese application No. 201310395574.9, dated Dec. 8, 2015. Translation provided by Dragon Intellectual Property Law Firm.

(Continued)

*Primary Examiner* — Long D Pham
(74) *Attorney, Agent, or Firm* — Harness, Dickey & Pierce, P.L.C.

(57) ABSTRACT

The present disclosure provides a pixel circuit, its driving method, an array substrate and a display device. The pixel circuit includes a plurality of pixels, each of which includes a blue sub-pixel and a driving module for driving the blue sub-pixel. The blue sub-pixel includes N blue OLEDs, and N is a positive integer greater than 1. The driving module is configured to drive the N blue OLEDs in a time division manner. According to the present disclosure, the blue sub-pixel is segmented into several portions, and merely a portion of the blue sub-pixel is displayed each time. As a (Continued)

result, it is able to prolong the service time of the blue sub-pixel, thereby to increase the service life of an AMOLED panel.

14 Claims, 2 Drawing Sheets

(52) U.S. Cl.
CPC ..... *G09G 2300/0452* (2013.01); *G09G 2300/0809* (2013.01); *G09G 2300/0842* (2013.01); *G09G 2310/08* (2013.01); *G09G 2320/0242* (2013.01); *G09G 2320/043* (2013.01); *G09G 2320/0666* (2013.01); *G09G 2330/08* (2013.01)

(58) Field of Classification Search
USPC ..... 345/82, 76
See application file for complete search history.

(56) References Cited

U.S. PATENT DOCUMENTS

| | | | | |
|---|---|---|---|---|
| 2008/0111777 | A1 | 5/2008 | Kim | |
| 2009/0128458 | A1 | 5/2009 | Kim et al. | |
| 2012/0062135 | A1* | 3/2012 | Tamaki | H05B 33/08 315/210 |
| 2012/0147065 | A1* | 6/2012 | Byun | G09G 3/3208 345/690 |
| 2013/0208021 | A1* | 8/2013 | Lee | G09G 3/32 345/690 |

FOREIGN PATENT DOCUMENTS

| | | | |
|---|---|---|---|
| CN | 102426821 | A | 4/2012 |
| CN | 102456315 | A | 5/2012 |
| CN | 102568376 | A | 7/2012 |
| CN | 103000132 | A | 3/2013 |
| CN | 103489401 | A | 1/2014 |
| KR | 100786849 | B1 | 12/2007 |
| WO | WO-2005101513 | A1 | 10/2005 |

OTHER PUBLICATIONS

Written Opinion of the International Searching Authority for international application No. PCT/CN2014/078971.
Chinese Office Action dated Jan. 28, 2015 regarding Application No. 2013103955749, filed Sep. 3, 2013 Translation provided by Dragon Intellectual Property Law Firm.

* cited by examiner

PIXEL CIRCUIT HAVING A PLURALITY OF BLUE ORGANIC LIGHT-EMITTING DIODES AND DRIVING METHOD THEREOF

CROSS-REFERENCE TO RELATED APPLICATIONS

This application is the U.S. national phase of PCT Application No. PCT/CN2014/078971 filed on May 30, 2014, which claims a priority of the Chinese patent application No. 201310395574.9 filed on Sep. 3, 2013, both of which are incorporated herein by reference in their entirety.

TECHNICAL FIELD

The present disclosure relates to the field of display driving technology, in particular to a pixel circuit, its driving method, an array substrate and a display device.

BACKGROUND

An existing active matrix organic light-emitting diode (AMOLED) panel includes a plurality of pixels, each of which includes a blue pixel unit, a red pixel unit and a green pixel unit. Usually, each blue pixel unit includes a blue organic light-emitting diode (OLED), each red pixel unit includes a red OLED, and each green pixel unit includes a green OLED.

FIG. 1 shows a commonly-used driver circuit for the pixel units, the driver circuit includes two transistors and one capacitor. One of the transistors is a switch tube T1 controlled by a scanning signal from a scanning line Scan so as to control the input of a data signal to a data line Data. The other transistor is a driving tube T2 for controlling the OLED to emit light. C represents a storage capacitor for maintaining a voltage applied to the driving tube T2 during a non-scanning period. The above circuit is called as a 2T1C driver circuit for the pixel units.

However, due to the defects of materials, the blue OLED is of low luminous efficiency and short service life. The blue pixels are of very poor luminous performance, and as a result, the image quality will be deteriorated seriously and the service life of the AMOLED panel will be shortened.

SUMMARY

An object of the present disclosure is to provide a pixel circuit, its driving method, an array substrate and a display device, so as to prolong the service time of blue pixels and increase the service life of an AMOLED panel.

In one aspect, the present disclosure provides a pixel circuit, including a plurality of pixels, each of which includes a blue sub-pixel and a driving module. The blue sub-pixel includes N blue organic light-emitting diodes (OLEDs), and N is a positive integer greater than 1. The driving module is configured to drive the N blue OLEDs in a time division manner.

During the implementation, the pixel further includes a red sub-pixel and a green sub-pixel, and the driving module is further configured to drive the red sub-pixel and the green sub-pixel while driving the N blue OLEDs in a time division manner.

During the implementation, the driving module includes a driver circuit for driving the blue sub-pixel in a time division manner, and the driver circuit includes an input transistor and N driving units. A gate electrode of the input transistor is connected to a scanning line, a first electrode thereof is connected to the N driving units, and a second electrode thereof is connected to a data line. A cathode of each of the N blue OLEDs is connected to a first level output end, and an anode thereof is connected to a level output end via the driving unit. The driving unit is configured to, when an absolute value of a voltage difference between a current level output end connected thereto and the first level output end is greater than an absolute value of a turn-on voltage of the blue OLED connected to the driving unit and when the level output ends other than the current level output end and the first level output end are floating, drive the blue OLED to emit light.

During the implementation, the driving unit includes a storage capacitor and N driving transistors. Gate electrodes of the N driving transistors are connected to each other, a second electrode of each driving transistor is connected to the level output end, and the storage capacitor is connected between the gate electrode and the first electrode of the driving transistor.

During the implementation, the driver circuit includes an input transistor, a driving transistor, and a storage capacitor. A gate electrode of the input transistor is connected to a scanning line, a first electrode thereof is connected to anodes of the N blue OLEDs via the storage capacitor, and a second electrode thereof is connected to a data line. A gate electrode of the driving transistor is connected to the first electrode of the input transistor, a first electrode thereof is connected to anodes of the N blue OLEDs, and a second electrode thereof is connected to a first level output end. The anodes of the N blue OLEDs are connected to each other, and cathodes thereof are connected to N level output ends, respectively. The driver circuit is configured to, when an absolute value of a voltage difference between the first level output end and one of the N level output ends is greater than an absolute value of a turn-on voltage of the blue OLED connected to the one of the N level output ends and when a voltage difference between the level output ends other than the one of the N level output ends and the first level output end is less than the absolute value of the turn-on voltage of the blue OLED, drive the blue OLED to emit light.

In another aspect, the present disclosure provides a method for driving the above-mentioned pixel circuit, including the step of driving, by a driving module, N blue OLEDs included in a blue sub-pixel of a pixel in a time division manner, wherein N is a positive integer greater than 1.

During the implementation, the driving module drives a red sub-pixel and a green sub-pixel of the pixel to which the blue sub-pixel belongs while driving the N blue OLEDs included in the pixel in a time division manner.

In yet another aspect, the present disclosure provides a method for driving the above-mentioned pixel circuit, including the step of driving, by a driving unit, the blue OLED to emit light when an absolute value of a voltage difference between a current level output end connected to the driving unit and a first level output end is greater than an absolute value of a turn-on voltage of the blue OLED connected to the driving unit and when the level output ends other than the current level output end and the first level output end are floating.

In still yet another aspect, the present disclosure provides a method for driving the above-mentioned pixel circuit, including the step of driving, by a driver circuit, the blue OLED to emit light when an absolute value of a voltage difference between the first level output end and one of the N level output ends is greater than an absolute value of a turn-on voltage of the blue OLED connected to the one of the N level output ends and when a voltage difference between the level output ends other than the one of the N level output ends and the first level output end is less than the absolute value of the turn-on voltage of the blue OLED.

In still yet another aspect, the present disclosure provides an array substrate including the above-mentioned pixel circuit.

In still yet another aspect, the present disclosure provides a display device including the above-mentioned array substrate.

According to the pixel circuit, its driving method, the array substrate and the display device of the present disclosure, the blue sub-pixel is segmented into several portions, and merely a portion of the blue sub-pixel is displayed each time. As a result, it is able to prolong the service time of the blue sub-pixel, thereby to increase the service life of the AMOLED panel.

DETAILED DESCRIPTION OF THE PREFERRED EMBODIMENTS

The solutions of the present disclosure will be described hereinafter in a clear and complete manner in conjunction with the drawings. Obviously, the following embodiments are merely a part of, rather than all of, the embodiments of the present disclosure, and based on these embodiments, a person skilled in the art can obtain the other embodiments without any creative effort, which also fall within the scope of the present disclosure.

A transistor used in the embodiments of the present disclosure may be a thin film transistor, a field-effect transistor or any other device of the same characteristics. In order to differentiate two electrodes other than a gate electrode of the transistor, one of them is called as "source electrode", and the other is called as "drain electrode". In addition, the transistor may be an N-type transistor or a P-type transistor in accordance with the characteristics thereof. For a driver circuit in the embodiments of the present disclosure, the transistor being an N-type transistor is taken as an example. Of course, the use of a P-type transistor may also be conceivable for a person skilled in the art without any creative effort, which also falls within the scope of the present disclosure.

According to the present disclosure, a blue sub-pixel of a pixel circuit for a display device is segmented into several portions, and merely a portion of the blue sub-pixel is displayed each time. As a result, it is able to prolong the service time of the blue sub-pixel. Especially for an AMOLED panel, the blue sub-pixel may be segmented into several portions, so as to drive, in a time division manner, a blue OLED of the blue sub-pixel to emit light and display a portion of the blue sub-pixel each time, thereby to prolong the service time of the blue sub-pixel and increase the service life of the AMOLED panel.

Figure 1:
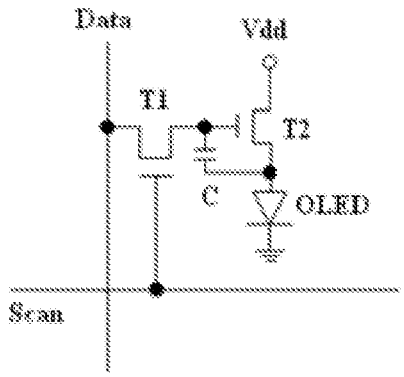
Fig. 1 Prior Art
FIG. 1 is a circuit diagram of an existing driver circuit for a pixel unit.
Figure 2:
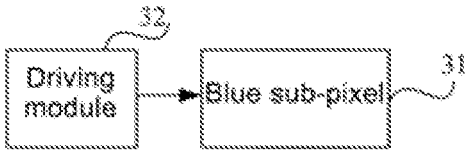
FIG. 2 is a schematic view showing a structure of a pixel included in a pixel circuit according to one embodiment of the present disclosure.

As shown in FIG. 2, a pixel circuit in the first embodiment of the present disclosure includes a plurality of pixels, each of which includes a blue sub-pixel 31 and a driving module 32 configured to drive the blue sub-pixel. The blue sub-pixel 31 includes N blue OLEDs (not shown), and N is a positive integer greater than 1. The driving module 32 is configured to drive the N blue OLEDs in a time division manner.

It should be appreciated that, the term "driving in a time division manner" refers to driving the blue sub-pixel or the N blue OLEDs in at least two periods of time so as to emit light. For example, the N blue OLEDs may be driven in N periods of time to emit light separately (N is a positive integer greater than 1), or P blue OLEDs may be driven in a certain period of time to emit limit concurrently ($2 \leq P \leq N$, and N is a positive integer greater than 3), or two portions B1 and B2 of the blue sub-pixel are driven in two periods of time to emit light, respectively.

According to the pixel circuit in the first embodiment of the present disclosure, the blue sub-pixel of the pixel is segmented into a plurality of blue OLEDs, the driving module is provided with the driver circuit for driving the plurality of blue OLEDs in a time division manner, and merely a portion of blue sub-pixel is displayed each time. As a result, it is able to prolong the service time of the blue sub-pixel, thereby to increase the service life of the AMOLED panel.

Figure 3:
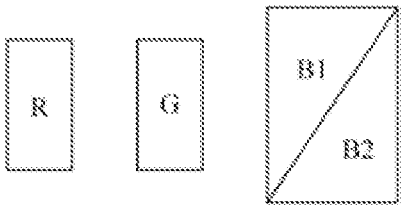
FIG. 3 is a block diagram showing a structure of the pixel circuit according to the first embodiment of the present disclosure.

As shown in FIG. 3, in an embodiment, each pixel includes a red sub-pixel R, a green sub-pixel G and a blue sub-pixel, and the driving module (not shown) is configured to drive the blue sub-pixel in a time division manner. In this embodiment, each blue sub-pixel is segmented into two portions, i.e., a first blue sub-pixel B1 and a second blue sub-pixel B2. Within a first period of time, the red sub-pixel R, the green sub-pixel G and the first blue sub-pixel B1 are driven to emit light, while within a second period of time, the red sub-pixel R, the green sub-pixel G and the second blue sub-pixel B2 are driven to emit light. In this way, the luminescence time for the first blue sub-pixel B1 or the second blue sub-pixel B2 is merely half that for the red sub-pixel R or the green sub-pixel G, and as a result, it is able to increase the service life of the AMOLED panel.

Referring to FIGS. 2 and 3, the blue sub-pixel includes two portions B1 and B2, so the N blue OLEDs may be segmented into two portions B1 and B2 too. In other words, for the pixel including the blue sub-pixel, the red sub-pixel and the green sub-pixel, the driving module is configured to drive the red sub-pixel and the green sub-pixel included in the pixel to which the N blue OLEDs belong while driving the N blue OLEDs in a time division manner.

In the above embodiments, merely the blue sub-pixel being segmented into two portions is taken as an example. In fact, the blue sub-pixel is segmented into at least two portions in this embodiment.

For example, the blue sub-pixel of the display device may be segmented into M portions, and merely 1/M of the blue sub-pixel is driven for each frame, so as to prolong the service time of the blue sub-pixel, thereby to increase the service life of the AMOLED panel. M represents the number of gate lines of the display device, and the term "frame" refers to the time for scanning all the gate lines by the display device.

Of course, the pixel may further include the sub-pixels in other colors, e.g., yellow. Although the blue sub-pixel is partially displayed each time after it is segmented into several portions, the mixed color effect of blue, red and green as well as the display quality will not be affected significantly due to the special nature of the blue display effect for the pixel. It should be appreciated that, the first period of time may be equal or unequal to the second period of time, and they may be set in accordance with the practical need. Alternatively, the first period of time is set as a first frame while the second period of time is set as a second frame. In this way, the first blue sub-pixel B1 and the second blue sub-pixel B2 may be driven to emit light alternately within the first frame and the second frame adjacent to each other, and as a result, it is able to keep the luminance time for the two blue sub-pixels in balance.

To be specific, referring to FIGS. 2 and 3, the N blue OLEDs are segmented into two portions B1 and B2, and the driving module 32 drives the red sub-pixel and the green sub-pixel included in the pixel to which the N blue OLEDs belong while driving the N blue OLEDs of the blue sub-pixel in a time division manner.

The blue sub-pixel B1 may include Q blue OLEDs, and at this time, B2 includes (N-Q) blue OLEDs, wherein $1 \leq Q \leq N$, and both Q and N are positive integers. Alternatively, the number of the blue OLEDs included in the blue sub-pixel B1 is equal to that included in the blue sub-pixel B2, e.g., N=2.

The driving module 32 may be implemented at least in one of the following modes.

Mode 1: the driving module 32 includes a driver circuit for driving the blue sub-pixel. This driver circuit may drive the N blue OLEDs, the red sub-pixel and the green sub-pixel synchronously. For example, one blue sub-pixel corresponds to one blue OLED, one red sub-pixel corresponds to one red OLED and one green sub-pixel corresponds to one green OLED, these three OLEDs will be connected serially or in parallel, and then driven by the driver circuit concurrently so as to emit light.

Mode 2: the driving module 32 includes a driver circuit for driving the blue sub-pixel (also called as a first driver circuit), a driver circuit for driving the red sub-pixel (also called as a second driver circuit) and a driver circuit for driving the green sub-pixel (also called as a third driver circuit). For example, one blue sub-pixel corresponds to one blue OLED (which is driven by the first driver circuit to emit light), one red sub-pixel corresponds to one red OLED (which is driven by the second driver circuit to emit light) and one green sub-pixel corresponds to one green OLED (which is driven by the third driver circuit to emit light), the red OLED is driven by the second driver circuit and the green OLED is driven by the third driver circuit to emit limit while the blue OLED is being driven by the first driver circuit to emit limit.

It should be appreciated that, in the driving module 32, the driver circuit for driving the blue sub-pixel, the driver circuit for driving the red sub-pixel and the driver circuit for driving the green sub-pixel may have the same or different structures/principles.

In the second embodiment which is obtained on the basis of the first embodiment and where merely the driver circuit for driving the blue sub-pixel is taken as an example, the driver circuit includes an input transistor and N driving units. A gate electrode of the input transistor is connected to a scanning line, a first electrode thereof is connected to the N driving units, and a second electrode thereof is connected to a data line. A cathode of each of the N blue OLEDs is connected to a first level output end, e.g., Elvss, and an anode thereof is connected to a level output end via the driving unit. The driving unit is configured to, when an absolute value of a voltage difference between a current level output end connected to the driving unit and the first level output end is greater than an absolute value of a turn-on voltage of the blue OLED connected to the driving unit and when the level output ends other than the current level output end and the first level output end are floating, drive the blue OLED to emit light. For example, the level output ends may include Elvdd1, Elvdd2, . . . , and Elvddn ($2 \leq n \leq N$, and both n and N are integers).

According to the pixel circuit in the second embodiment of the present disclosure, the driver circuit includes the input transistor and the N driving units for driving the N blue OLEDs respectively. The N driving units may be of circuit structures identical to, or different from, each other, as long as the absolute value of the voltage difference between the current level output end connected to the driving unit and the first level output end is greater than the absolute value of the turn-on voltage of the blue OLED connected to the driving unit and the level output ends other than the current level output end and the first level output end are floating. Hence, the blue OLEDs may be driven in a flexible manner.

Figure 4:
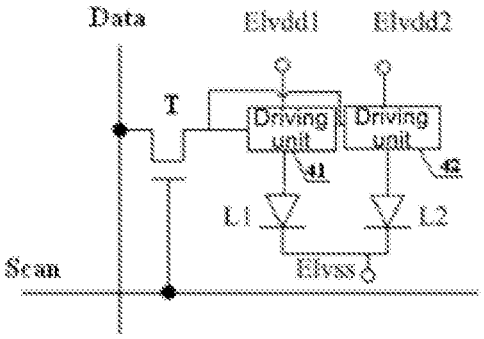
FIG. 4 is a circuit diagram of the pixel circuit according to the second embodiment of the present disclosure when N=2.

FIG. 4 is a circuit diagram of the pixel circuit according to the second embodiment of the present disclosure when N=2. In FIG. 4, T represents the input transistor. The gate electrode of the input transistor T is connected to the scanning lien Scan, the first electrode thereof is connected to the driving units 41, 42, and the second electrode thereof is connected to the data lien Data. The driving unit 41 is connected to an anode of a blue OLED L1, and the driving unit 42 is connected to an anode of a blue OLED L2. A cathode of the blue OLED L1 and a cathode of the blue OLED L2 are connected to the first level output end Elvss. The anode of the blue OLED L1 is connected to the level output end Elvdd1 via the driving unit 41, and the anode of the blue OLED L2 is connected to the level output end Elvdd2 via the driving unit 42.

In the third embodiment of the present disclosure which is obtained on the basis of the second embodiment, the driving unit includes a storage capacitor and N driving transistors. Gate electrodes of the N driving transistors are connected to each other, a second electrode of each driving transistor is connected to the level output end, and the storage capacitor is connected between the gate electrode and the first electrode of each driving transistor.

Figure 5:
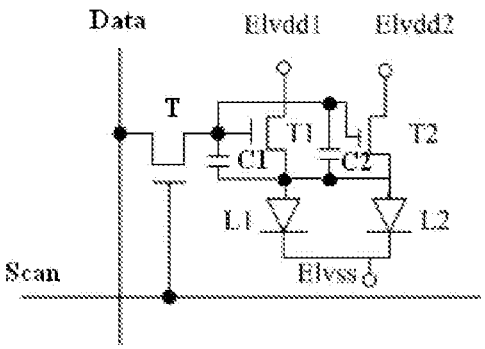
FIG. 5 is a circuit diagram of the pixel circuit according to the third embodiment of the present disclosure when N=2.

As shown in FIG. 5, which is a circuit diagram of the pixel circuit according to the third embodiment of the present disclosure when N=2, the first driving unit includes a first driving transistor T1 and a first storage capacitor C1, and the second driving unit includes a second driving transistor T2 and a second storage capacitor C2. The first storage capacitor C1 is connected between a gate electrode and a first electrode of the first driving transistor T1, and the second storage capacitor C2 is connected between a gate electrode and a first electrode of the second driving transistor T2. The first electrode of the input transistor T is connected to the gate electrode of the first driving transistor T1 and the gate electrode of the second driving transistor T2, respectively. A second electrode of the first driving transistor T1 is connected to the level output end Elvdd1, and a second electrode of the second driving transistor T2 is connected to the level output end Elvdd2.

Referring to FIG. 2, the first blue OLED L1 corresponds to the first blue sub-pixel B1, and the second blue OLED L2 corresponds to the second blue sub-pixel B2. When the red sub-pixel R, the green sub-pixel G and the first blue sub-pixel B1 are driven to emit light, Elvdd1 outputs a positive voltage, Elvdd2 is floating, and at this time, L1 is turned on, and L2 is turned off. When the red sub-pixel R, the green sub-pixel G and the second blue sub-pixel B2 are driven to emit light, Elvdd1 is floating, Elvdd2 outputs a positive voltage, and at this time, L2 is turned on and L1 is turned off.

In the fourth embodiment of the present disclosure which is obtained on the basis of the first embodiment, the driver circuit includes an input transistor, a driving transistor and a storage capacitor. A gate electrode of the input transistor is connected to the scanning line, a first electrode thereof is connected to the anodes of the N blue OLEDs via the storage capacitor, and a second electrode thereof is connected to the data line. A gate electrode of the driving transistor is connected to the first electrode of the input transistor, a first electrode of the driving transistor is connected to the anodes of the N blue OLEDs, and a second electrode thereof is connected to the first level output end. The anodes of the N blue OLEDs are connected to each other, and the cathodes thereof are connected to the N level output ends, respectively. The driver circuit is configured to, when an absolute value of a voltage difference between the first level output end and one of the N level output ends is greater than an absolute value of a turn-on voltage of the blue OLED connected to the one of the N level output ends and when a voltage difference between the level output ends other than the one of the N level output ends and the first level output end is less than the absolute value of the turn-on voltage of the blue OLED, drive the blue OLED to emit light.

Figure 6:
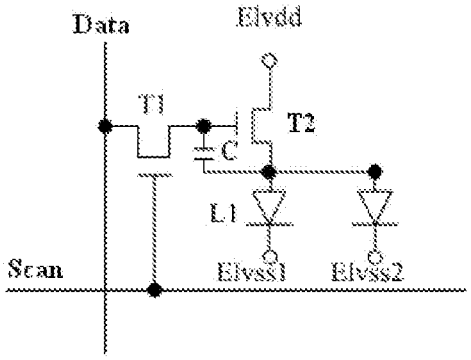
FIG. 6 is a circuit diagram of the pixel circuit according to the fourth embodiment of the present disclosure when N=2.

As shown in FIG. 6, which is a circuit diagram of the pixel circuit according to the fourth embodiment of the present disclosure when N=2. The blue sub-pixel includes the first blue OLED L1 and the second blue OLED L2. The anode of the first blue OLED L1 is connected to the anode of the second blue OLED L2, the cathode of the first blue OLED L1 is connected to the level output end Elvss1, and the cathode of the second blue OLED L2 is connected to the level output end Elvss2.

The driver circuit includes an input transistor T1, a driving transistor T2 and a storage capacitor C. A gate electrode of the input transistor T1 is connected to the scanning line Scan, a first electrode thereof is connected to the anode of the first blue OLED L1 via the storage capacitor C, and a second electrode thereof is connected to the data line Data. A gate electrode of the driving transistor T2 is connected to the first electrode of the input transistor T1, a first electrode thereof is connected to the anode of the first blue OLED L1, and a second electrode thereof is connected to the first level output end Elvdd. The first blue OLED L1 corresponds to the first blue sub-pixel B1, and the second blue OLED L2 corresponds to the second blue sub-pixel B2. When the red sub-pixel R, the green sub-pixel G and the first blue sub-pixel B1 are driven to emit light, Elvss1 outputs a negative voltage, Elvss2 outputs a positive voltage, and at this time, L1 is turned on and L2 is turned off. When the red sub-pixel R, the green sub-pixel G and the second blue sub-pixel B2 are driven to emit light, Elvss1 outputs a positive voltage, Elvss2 outputs a negative voltage, and at this time, L2 is turned on and L1 is turned off.

Figure 7:
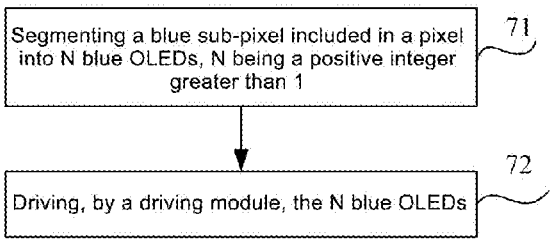
FIG. 7 is a flow chart showing a method for driving the pixel circuit according to the first embodiment of the present disclosure.

As shown in FIG. 7, a method for driving the pixel circuit according to the first embodiment of the present disclosure includes:

Step 71: segmenting the blue sub-pixel included in the pixel into N blue OLEDs, N being a positive integer greater than 1; and Step 72: driving, by the driving module which includes the driver circuit for driving the blue sub-pixel in a time division manner, the N blue OLEDs.

It should be appreciated that, the term "driving in a time division manner" refers to driving the blue sub-pixel or the N blue OLEDs in at least two periods of time so as to emit light. For example, the N blue OLEDs may be driven in N periods of time to emit light separately (N is a positive integer greater than 1), or P blue OLEDs may be driven in a certain period of time to emit limit concurrently ($2 \leq P \leq N$, and N is a positive integer greater than 3), or two portions B1 and B2 of the blue sub-pixel are driven in two periods of time to emit light, respectively.

According to the method for driving the pixel circuit in the first embodiment of the present disclosure, the blue sub-pixel included in the pixel is segmented into a plurality of blue OLEDs which are driven by the driving module in a time division manner, and merely a portion of the blue sub-pixel is displayed each time. As a result, it is able to prolong the service time of the blue sub-pixel, thereby to increase the service life of the AMOLED panel.

In an embodiment, the driving module drives the red sub-pixel and the green sub-pixel included in the pixel to which the N blue OLEDs belong while driving the N blue OLEDs in a time division manner.

The method for driving the pixel circuit according to the second embodiment of the present disclosure includes:

segmenting the blue sub-pixel included in the pixel into N blue OLEDs, N being a positive integer greater than 1; and driving, by the driving unit, the blue OLED to emit light when an absolute value of a voltage difference between a current level output end connected to the driving unit and a first level output end is greater than an absolute value of a turn-on voltage of a current blue OLED connected to the driving unit and when the level output ends other than the current level output end and the first level output end are floating.

The method for driving the pixel circuit according to the third embodiment of the present disclosure includes:

segmenting the blue sub-pixel included in the pixel into N blue OLEDs, N being a positive integer greater than 1; and driving, by the driving circuit, the blue OLED to emit light when an absolute value of a voltage difference between the first level output end and one of the N level output ends is greater than an absolute value of a turn-on voltage of the blue OLED connected to the one of the N level output ends and when a voltage difference between the level output ends other than the one of the N level output ends and the first level output end is less than the absolute value of the turn-on voltage of the blue OLED.

The present disclosure further provides an array substrate including the above-mentioned pixel circuit.

The present disclosure further provides a display device including the above-mentioned array substrate.

The above are merely the preferred embodiments of the present disclosure. It should be appreciated that, a person skilled in the art may make further modifications and improvements without departing from the principle of the present disclosure, and these modifications and improvements shall also fall within the scope of the present disclosure.

What is claimed is:

1. A pixel circuit, comprising a plurality of pixels, each of the plurality of pixels includes a blue sub-pixel and a driving module, wherein the blue sub-pixel comprises N blue organic light-emitting diodes (OLEDs), and N is a positive integer greater than 1, the driving module is configured to drive the N blue OLEDs in a time division manner, wherein the driving module comprises a driver circuit for driving the blue sub-pixel in a time division manner, and the driver circuit includes an input transistor and N driving units, a gate electrode of the input transistor is connected to a scanning line, a first electrode of the input transistor is connected to the N driving units, and a second electrode of the input transistor is connected to a data line, a cathode of each of the N blue OLEDs is connected to a first level output end, and an anode thereof is connected to a level output and via the driving unit, and the driving unit is configured to, when an absolute value of a voltage difference between a current level output end connected to the driving unit and the first level output end is greater than an absolute value of a turn-on voltage of the blue OLED connected to the driving unit and when the level output ends other than the current level output end and the first level output end are floating, drive the blue OLED to emit light.

2. The pixel circuit according to claim 1, wherein the pixel further comprises a red sub-pixel and a green sub-pixel, and the driving module is further configured to drive the red sub-pixel and the green sub-pixel while driving the N blue OLEDs in a time division manner.

3. The pixel circuit according to claim 1, wherein the driving unit comprises a storage capacitor and N driving transistors, gate electrodes of the N driving transistors are connected to each other, a second electrode of each driving transistor is connected to the level output end, and the storage capacitor is connected between the gate electrode and the first electrode of the driving transistor.

4. A method for driving the pixel circuit according to claim 1, comprising:

segmenting a blue sub-pixel included in a pixel into N blue OLEDs, N being a positive integer greater than 1; and driving, by a driving unit, the blue OLED to emit light when an absolute value of a voltage difference between a current level output end connected to the driving unit and a first level output end is greater than an absolute value of a turn-on voltage of the blue OLED connected to the driving unit and when the level output ends other than the current level output end and the first level output end are floating.

5. The method according to claim 4, wherein the driving module drives a red sub-pixel and a green sub-pixel of the pixel to which the blue sub-pixel belongs while driving the N blue OLEDs included in the pixel in a time division manner.

6. An array substrate comprising the pixel circuit according to claim 1.

7. A display device comprising the array substrate according to claim 6.

8. The array substrate according to claim 6, wherein the pixel further comprises a red sub-pixel and a green sub-pixel, and the driving module is further configured to drive the red sub-pixel and the green sub-pixel while driving the N blue OLEDs in a time division manner.

9. The array substrate according to claim 6, wherein the driving unit comprises a storage capacitor and N driving transistors, gate electrodes of the N driving transistors are connected to each other, a second electrode of each driving transistor is connected to the level output end, and the storage capacitor is connected between the gate electrode and the first electrode of the driving transistor.

10. A pixel circuit, comprising a plurality of pixels, each of the plurality of pixels includes a blue sub-pixel and a driving module, wherein:

the blue sub-pixel comprises N blue organic light-emitting diodes (OLEDs), and N is a positive integer greater than 1, the driving module is configured to drive the N blue OLEDs in a time division manner, the driving module comprises a driver circuit for driving the blue sub-pixel in a time division manner, the driver circuit comprises an input transistor, a driving transistor, and a storage capacitor, a gate electrode of the input transistor is connected to a scanning line, a first electrode of the input transistor is connected to anodes of the N blue OLEDs via the storage capacitor, and a second electrode of the input transistor is connected to a data line, a gate electrode of the driving transistor is connected to the first electrode of the input transistor, a first electrode of the driving transistor is connected to anodes of the N blue OLEDs, and a second electrode of the driving transistor is connected to a first level output end, the anodes of the N blue OLEDs are connected to each other, and cathodes of the N blue OLEDs are connected to N level output ends, respectively, and the driver circuit is configured to, when an absolute value of a voltage difference between the first level output end and one of the N level output ends is greater than an absolute value of a turn-on voltage of the blue OLED connected to the one of the N level output ends and when a voltage difference between the level output ends other than the one of the N level output ends and the first level output end is less than the absolute value of the turn-on voltage of the blue OLED, drive the blue OLED to emit light.

11. A method for driving the pixel circuit according to claim 10, comprising:

segmenting a blue sub-pixel included in a pixel into N blue OLEDs, N being a positive integer greater than 1; and driving, by a driver circuit, the blue OLED to emit light when an absolute value of a voltage difference between the first level output end and one of the N level output ends is greater than an absolute value of a turn-on voltage of the blue OLED connected to the one of the N level output ends and when a voltage difference between the level output ends other than the one of the N level output ends and the first level output end is less than the absolute value of the turn-on voltage of the blue OLED.

12. The method according to claim 11, wherein the driving module drives a red sub-pixel and a green sub-pixel of the pixel to which the blue sub-pixel belongs while driving the N blue OLEDs included in the pixel in a time division manner.

13. An array substrate comprising the pixel circuit according to claim 10.

14. A display device comprising the array substrate according to claim 13.

* * * * *